US010658803B2

(12) United States Patent
Gartmann

(10) Patent No.: US 10,658,803 B2
(45) Date of Patent: May 19, 2020

(54) CIRCUIT BOARD COAXIAL CONNECTOR

(71) Applicant: HUBER+SUHNER AG, Herisau (CH)

(72) Inventor: Martin Gartmann, Teufen (CH)

(73) Assignee: HUBER+SUHNER AG, Herisau (CH)

( * ) Notice: Subject to any disclaimer, the term of this patent is extended or adjusted under 35 U.S.C. 154(b) by 0 days.

(21) Appl. No.: 16/091,875

(22) PCT Filed: May 11, 2017

(86) PCT No.: PCT/EP2017/061408
§ 371 (c)(1),
(2) Date: Oct. 5, 2018

(87) PCT Pub. No.: WO2017/194715
PCT Pub. Date: Nov. 16, 2017

(65) Prior Publication Data

US 2019/0165525 A1 May 30, 2019

Related U.S. Application Data

(60) Provisional application No. 62/335,096, filed on May 12, 2016.

(51) Int. Cl.

| | |
|---|---|
| ***H01R 13/40*** | (2006.01) |
| ***H01R 24/54*** | (2011.01) |
| ***H01R 13/506*** | (2006.01) |
| ***H01R 12/91*** | (2011.01) |

(Continued)

(52) U.S. Cl.
CPC ..... *H01R 24/542* (2013.01); *H01R 12/91* (2013.01); *H01R 13/40* (2013.01); *H01R 13/506* (2013.01); *H01R 12/73* (2013.01); *H01R 13/42* (2013.01)

(58) Field of Classification Search
CPC ..... H01R 24/542; H01R 13/40; H01R 12/91; H01R 13/506; H01R 12/73; H01R 13/42
See application file for complete search history.

(56) References Cited

U.S. PATENT DOCUMENTS

| | | | |
|---|---|---|---|
| 4,925,403 | A | 5/1990 | Zorzy |
| 5,879,177 | A | 3/1999 | Homma |

(Continued)

FOREIGN PATENT DOCUMENTS

| | | | |
|---|---|---|---|
| CN | 2879475 | Y | 3/2007 |
| CN | 101459304 | A | 6/2009 |

(Continued)

*Primary Examiner* — Truc T Nguyen
(74) *Attorney, Agent, or Firm* — Pauley Erickson & Kottis

(57) ABSTRACT

The present invention relates to an adapter (1) for a coaxial connector assembly (2) comprising a tubular outer conductor (3) and a pin-shaped inner conductor (4) both extending in a mounted position in a longitudinal direction (z) and a spacer (5) which in the mounted position is arranged inside the outer conductor (3) encompassing the inner conductor (4) at least partially and by which the inner conductor (4) is positioned with respect to the outer conductor (3). The spacer (5) comprises a first half (5*a*) and a second half (5*b*) which are interconnectable to each other along a separation plane extending in the longitudinal direction (z), wherein the first and/or the second half (5*a*, 5*b*) comprise at least one holding means (6) to hold the inner conductor (4) in the mounted position.

12 Claims, 5 Drawing Sheets

(51) Int. Cl.
*H01R 12/73* (2011.01)
*H01R 13/42* (2006.01)

(56) References Cited

U.S. PATENT DOCUMENTS 6,200,163 B1* 3/2001 O'Sullivan ..... H01R 9/0518 439/579
6,250,960 B1* 6/2001 Youtsey ..... H01R 9/0503 439/578
6,491,546 B1* 12/2002 Perry ..... H01R 24/542 439/133
2004/0038586 A1 2/2004 Hall et al.
2004/0114995 A1* 6/2004 Jones ..... H01P 1/045 403/294
2005/0277331 A1* 12/2005 Hall ..... H01R 24/542 439/578
2006/0194465 A1 8/2006 Czikora
2007/0026698 A1 2/2007 Rosenberger
2007/0190868 A1* 8/2007 De Cloet ..... H01R 13/6277 439/851
2012/0214339 A1* 8/2012 Stein ..... H01R 13/111 439/578
2013/0102190 A1* 4/2013 Chastain ..... H01R 24/542 439/583
2013/0115809 A1* 5/2013 Hanson ..... H01R 13/2421 439/578
2014/0030936 A1 1/2014 Sandoval et al.
2015/0118899 A1* 4/2015 Hugel ..... H01R 24/542 439/578
2015/0340816 A1* 11/2015 Abe ..... H01R 13/6582 439/607.34

FOREIGN PATENT DOCUMENTS

DE 39 03 886 A1 8/1990
EP 1 207 592 A2 5/2002
WO WO 00/52788 A1 9/2000
WO WO 2006/115813 A1 11/2006

* cited by examiner

CIRCUIT BOARD COAXIAL CONNECTOR

BACKGROUND OF THE INVENTION

Field of the Invention

The present invention relates to an adapter for a coaxial connector assembly for circuit boards according to the preamble of the patent claims.

Discussion of Related Art

Circuit boards arranged in a case are often contact-connected to one another in a vertical direction to transfer signals. As often more than one contact point is present, it is necessary to compensate for locational and positional inaccuracies in a lateral as well as a longitudinal direction, in order to maintain the radiofrequency properties. Special connector assemblies are known from the same applicant for this purpose. They normally comprise a first and a second connector part which in the mounted position are interconnected to each other by an adapter.

U.S. Pat. No. 4,925,403 was published in 1988 on behalf of the Gilbert Engineering CO and discloses a coaxial connector of the type described comprising an adapter piece. The connector is constructed such that it can compensate for a certain lateral offset. A mechanical snap-action connection is produced by means of an outer conductor of the adapter piece.

U.S. Pat. No. 5,879,177, published in 1999 on behalf of the NEC Corporation, discloses a further connector comprising a first and a second connector part, which can be operatively connected by an adapter piece. The adapter piece serves to compensate for a certain lateral offset.

WO 0052788A1 from the Huber and Suhner A G was published in 2000 and discloses an improved connector of the generic type. The connector has a first and a second connector part, which can be operatively connected by means of an adapter piece. In order to reduce forces that arise, a ball-and-socket joint is used at least on one side.

EP 1207592 was published in 2002 on behalf of the Rosenberger Hochfrequenztechnik GmbH and relates to a coaxial plug arrangement comprising a first and a second coaxial plug connector and a contact sleeve connecting them. The contact sleeve is designed such that it is laterally tiltable in a predetermined region. The first coaxial plug connector and the contact sleeve have a latching connection in the region of their outer conductor. The latching connection in the region of the outer conductors has a restrictive effect on the freedom of movement. All first coaxial plug connectors are arranged in a common first plastic housing and all second coaxial plug connectors are arranged in a common second plastic housing.

Further generic connectors are known from US 2004038586, US 2007026698 A, US 2006194465A, CN 2879475Y, and CN 101459304A.

A crucial element of the connector assembly is the adapter which interconnects the first and the second connector part. It is an important element of the signal path as it has a significant influence on the signal quality. In the connector assemblies known from the prior art, the adapter has preferably a design which is as rotation-symmetric as possible, since under normal circumstances a deviation from that the design would result in a negative impact on the transmission of the signal.

One object of the invention is to provide a cost efficient adapter for a coaxial connector assembly as described hereinafter.

SUMMARY OF THE INVENTION

The adapter according to the invention is foreseen to be used in a coaxial connector assembly which comprises a first and a second connector part. In an assembled position the first and the second connector part are electrically interconnected through the adapter to each other. The coaxial connector assembly is suitable to be used for interconnecting a first and a second printed circuit board.

An adapter according to the invention comprises a tubular outer conductor and an inner conductor both extending in a mounted position in the coaxial (longitudinal) direction of the adapter. The inner conductor of the adapter is pin-shaped.

During operation, the inner conductor of the adapter is interconnected at one end to an inner conductor of the first connector part. At the other end, the inner conductor of the adapter is connected to an inner conductor of the second connector part to establish an electrical path. The outer conductor of the adapter is connected on each end correspondingly to an outer conductor of the first, respectively the second, connector part to establish the electrical path of the outer conductors. A spacer is arranged inside the outer conductor of the adapter encompassing the inner conductor of the adapter at least partially and by which the inner conductor of the adapter is positioned with respect to the outer conductor of the adapter. In a preferred variation the spacer comprises a first half and a second half which are interconnectable to each other along a separation plane extending in the longitudinal direction. In that case, the first and/or the second half of the spacer may comprise at least one holding means to hold the inner conductor of the adapter in the mounted position. The two halves of the spacer may further be connectable by a hinge for an easy assembly.

The inner conductor of the adapter can consist of at least one punched sheet metal part with a defined thickness to contribute to a cost efficient construction. Preferably, the inner conductor of the adapter than has an in principle rectangular cross-section, defined by the thickness of the punched sheet metal and a lateral extension of the punched sheet metal in a lateral direction. The lateral direction is perpendicular to the longitudinal direction.

The lateral extension of the inner conductor of the adapter may further vary over the length of the inner conductor in longitudinal direction. Preferably, the lateral extension is symmetrical in respect to a middle axis of the adapter which is extending in the longitudinal direction. Even further advantageously, the lateral extensions of the inner conductor of the adapter is symmetrical in respect to a lateral axis, extending in the lateral direction in the middle of the inner conductor. In the assembled state, the lateral extension may be arranged in the spacer. The lateral extension may also be used in order to fixate the inner conductor in the longitudinal direction with respect to the spacer.

One possible shape of the inner conductor of the adapter is defined by a thickening in the lateral direction (lateral extension) in the middle of said inner conductor. Alternatively or additionally, said inner conductor may be defined by two lateral thickenings which are each arranged symmetrically to the lateral axis, between the lateral axis and an end of the inner conductor in the longitudinal direction. This setup has proven to offer an optimal impedance which in turn affects the return loss.

In the mounted position, the lateral extension of the inner conductor of the adapter may be arranged perpendicular or parallel with respect to the separation plane of the spacer. The perpendicular arrangement however, has the advantage that it is easier to assemble and has an overall better transmission quality than the parallel arrangement. Furthermore, the perpendicular arrangement has shown to have a good return loss and a better dielectric withstanding voltage than the parallel arrangement of said inner conductor.

If the inner conductor of the adapter is made of punched sheet metal, it is further advantageous that the inner conductor comprises with respect to the longitudinal direction at least at one end a fork-like extension that extends in the lateral as well as in the longitudinal direction. However, preferably both ends feature a fork-like extension in order to electrically interconnect the inner conductor of the adapter to the inner conductors of the respective first and second connector parts of the connector assembly. A fork-like extension comprises two legs, which extent in general in the longitudinal direction but also feature an extension in the lateral direction. The extension of the legs in the longitudinal direction is hereby larger than the extension in the lateral direction. Preferably, the two legs are symmetrically to each other in respect to the middle axis to avoid undesired shear forces. The shape of the two legs results in a resilient behavior of the fork-like extension in lateral direction. In the mounted position, the legs press in the lateral direction outwards against a contact surface of the inner conductors of the connector parts to ensure the electrical path of the inner conductors. Preferably, the frontal ends of the inner conductors of the connector parts are shaped in form of a hollow cylinder. In that case, the contact surfaces are located at the inner circumferential surface of the respective hollow cylinders in which the fork-like extension can be inserted. The design of the ends of the inner conductor of the adapter and the respective ends of the inner conductor of the connector parts shapes ensure a reliable electrical interconnection while using a punched sheet metal as a base material for the inner conductor of the adapter. The effect is further enhanced by using a material for the punched metal sheet that has suitable resilient qualities.

For an overall cost efficient design, the outer conductor of the adapter may also consist of at least one punched sheet metal part. In this case the shaped punched metal sheet may be reshaped to form a hollow cylinder. Therefore, firstly an outline of the developed view of the outer conductor of the adapter is stamped in the punched metal sheet. Thin predetermined breaking points may alternatively remain between the punched metal sheet forming later the outer conductor and the rest of the punched metal sheet in order to remove the outer conductor in a later process step. Secondly, the punched metal sheet is bend in the respective form of a hollow cylinder in such a way that two edges of the metal sheet forming the outer conductor are flush facing each other and thus form an interconnection section. Engagement means may be present at the two edges of the punched sheet metal in order to interconnect the two edges to each other at the interconnection section through e.g. a form-fit. If engagement means are present, these means may already be interlocked in the above described bending process. One possible variation of an engagement means may be a lock. Additionally or alternatively, the two edges may also be connected by welding and/or brazing and/or adhesive bonding.

Preferably, both ends of the outer conductor of the adapter in the longitudinal direction are designed slotted such that separate spring tongues are formed which are bendable in the radial direction outwards. The slots which later form the spring tongues may be already integrated in the contour of the punched metal sheet, if such a metal sheet is used. The spring tongues can then be used in order to built-up a sufficient contact to the respective outer conductors of the first and the second connector part. Therefore, the spring tongues may further feature contact beads on which the electrical contact is preferably established.

In some variations, the at least one holding means of the spacer can comprise a recess and/or a protrusion to receive the inner conductor of the adapter and at least partly circumvents the said inner conductor. If the spacer comprises multiple parts the holding means may be present at least in one part of the spacer. Advantageously, if the spacer comprise two parts, the holding means is formed such that a recess is present in both spacer halves to receive in the mounted position at least partly the inner conductor of the adapter. The holding means ensure an easy assembly and precise positioning of the inner conductor of the adapter. Furthermore, the holding means may be designed such that a lateral extension in the longitudinal direction of said holding means can vary and the holding means accommodates for the fact that the lateral extension of the inner conductor of the adapter may vary in longitudinal direction.

The first and the second half of the spacer may further comprise an interconnection means to mechanically interconnect the first and the second half of the spacer to each other during assembly. Advantageously, either the first or the second part of the spacer comprise at least one protrusion, meanwhile the other half comprise a corresponding recess to receive said protrusion such that a plug connection is formed. Preferably, the at least one protrusion is slightly oversized in respect to the corresponding recess such that a stronger interconnection of the spacer halves is formed through a press-fit.

Additionally or alternatively, the spacer halves may each have at least one compensating element at an outer side. The outer side is facing the outer conductor of the adapter in the assembled state. The compensating element may have the form of a recess and serves for an electric compensation.

Preferably, the spacer is further made from a dielectric material and hence insulates the inner conductor and the outer conductor of the adapter against each other at least partly over the longitudinal direction.

The outer shape of the spacer and the inner shape of the tubular outer conductor of the adapter may be designed such that the spacer can be inserted into the outer conductor of the adapter in the longitudinal direction. In some variations, the spacer and the outer conductor of the adapter may additionally comprise either one of a snap-fit or a thereto corresponding recess which interact with each other in the mounted position. This snap-fit connection can secure the insertion of the spacer in the outer conductor of the adapter in the longitudinal direction. Preferably, the snap-fit connection is orientated in the middle of the outer conductor of the adapter in respect to the longitudinal direction such that the outer conductor is essentially symmetrical. However, a variation where the snap-fit is orientated asymmetrically such that a user can optically distinguish the two ends of the adapter from each other is also possible.

At least one connector side may in some variations e.g. have a mechanical connection which connects the corresponding connector part and an assigned end of the adapter "fixedly" to each other that under normal circumstances the connection is no longer releasable at all or releasable by application of an elevated force. The mechanical connection may be realized by latches formed at one end of the spacer that latch behind a circumferential holding bead of the respective connector part. Preferably, the holding bead is located at an isolator, which is located between the outer and the inner conductor of the respective connector part. If latches are present at the spacer, the spacer, and therefore also the adapter, is asymmetrically built-up in respect to the above defined lateral axis. For the latches to be bendable in the assembled adapter, a clearance between the part of the spacer which forms the latches and the outer conductor and inner conductor of the adapter is needed.

In contrast thereto, the operative connection of the other connector part to the adapter can be released at a lower force level. Therefore, the adapter can be connected to that connector part by a plug connection that is telescopically adjustable in the longitudinal direction. This further enables the detachment of the adapter from the respective connector part at the lower force level than the detachment of the mechanical connection at the other side of the adapter. To provide the optimum capture range during interconnection, the side of the adapter with the less strong interconnection (plug connection) may further provide a capture funnel. The capture funnel can be attached to the corresponding connector part as a separate part or the capture funnel can be an integral part of the respective connector part.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DETAILED DESCRIPTION OF THE INVENTION

Reference will now be made in detail to certain embodiments, examples of which are illustrated in the accompanying drawings, in which some, but not all features are shown. Indeed, embodiments disclosed herein may be embodied in many different forms and should not be understood as limited to the embodiments set forth herein; rather, these embodiments are provided so that this disclosure will satisfy applicable legal requirements. Whenever possible, like reference numbers will be used to refer to like components or parts.

Figure 1:
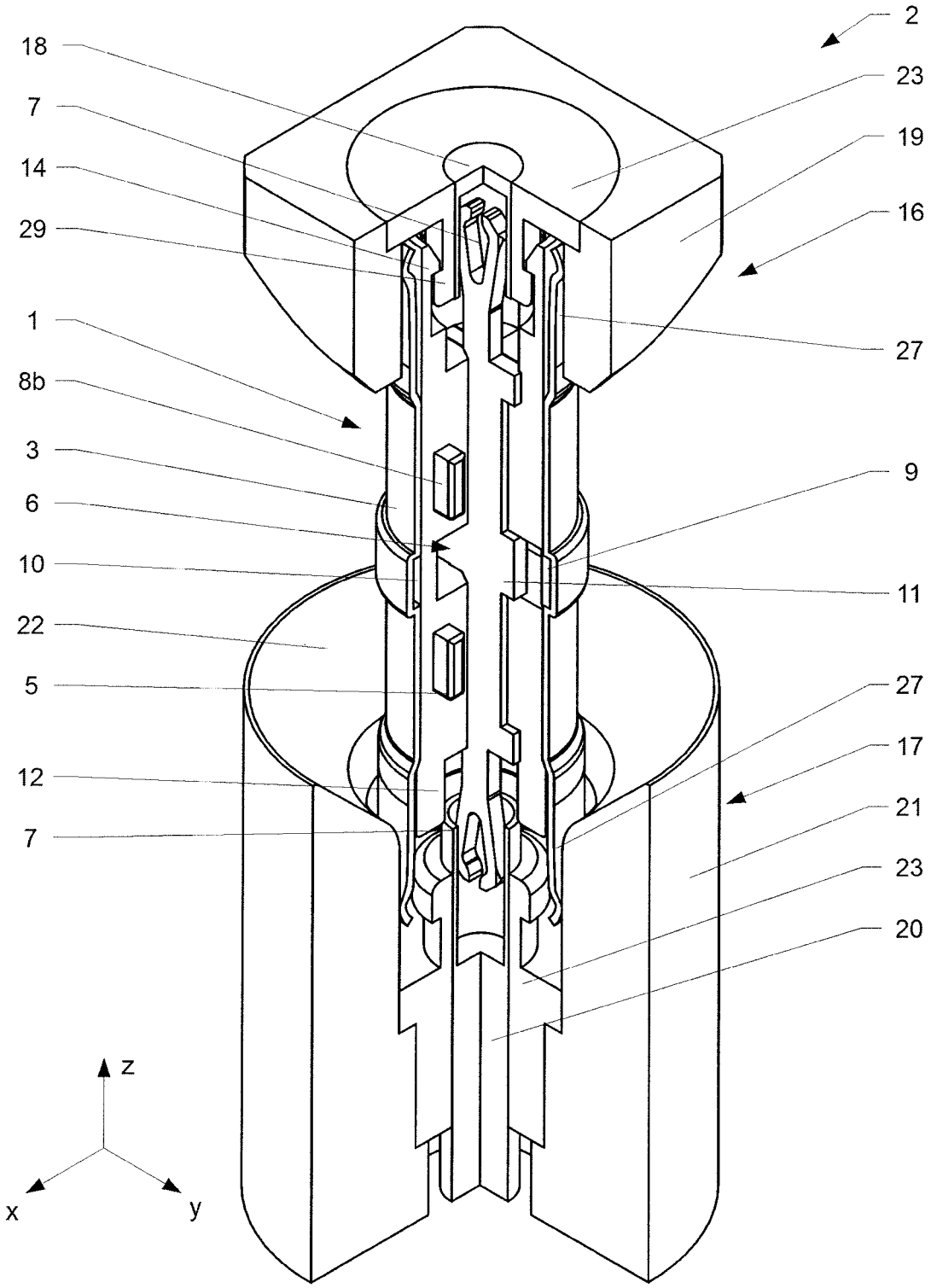
FIG. 1 shows a coaxial connector assembly with an adapter according to the invention in a perspective view, partly sectional.
Figure 2:
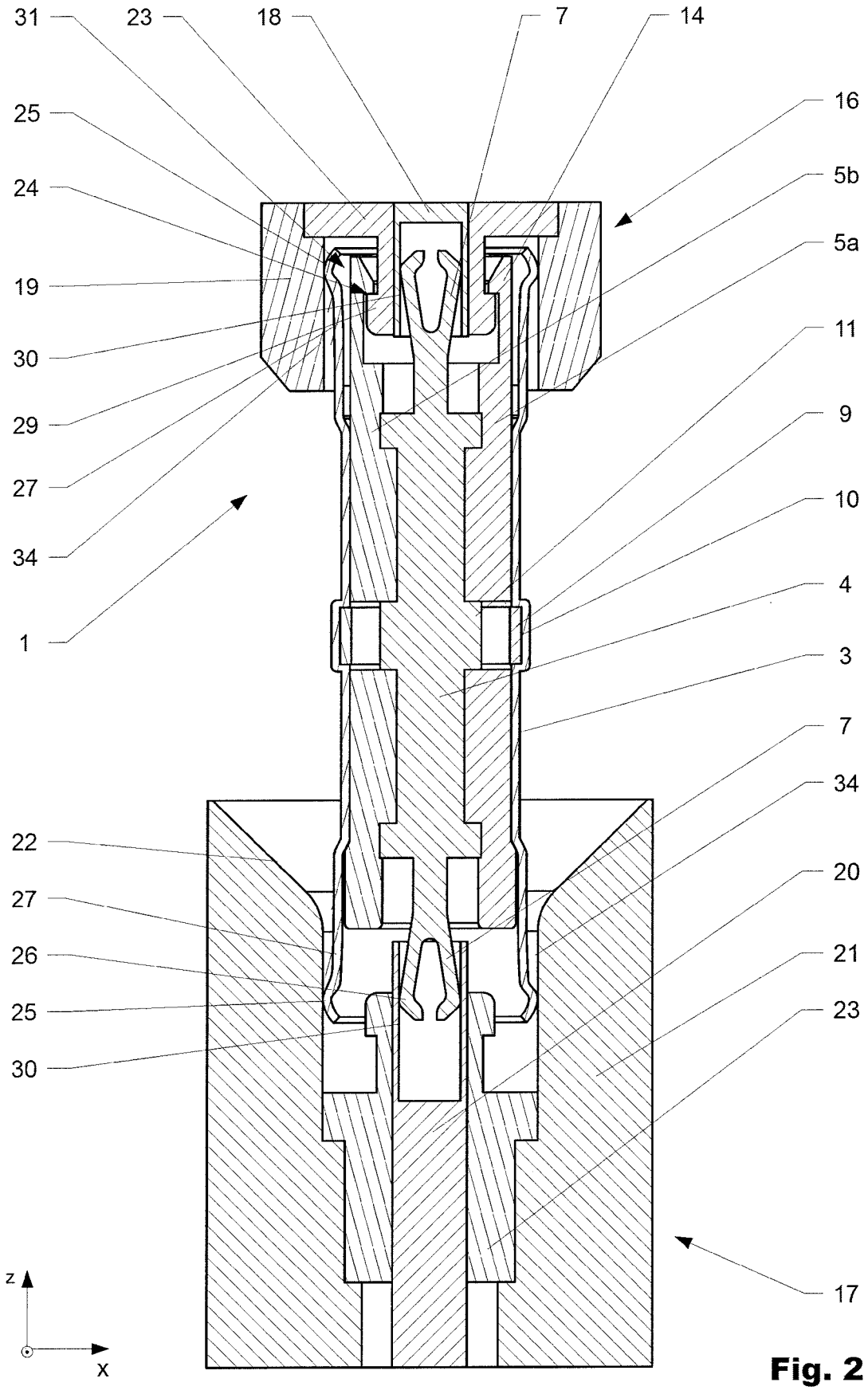
FIG. 2 shows the coaxial connector assembly according to FIG. 1 in a sectional view.

FIG. 1 and FIG. 2 show a variation of a coaxial connector assembly 2 with an adapter 1 according to the invention in a mounted position. The coaxial connector assembly comprises a first connector part 16 and a second connector part 17 with the adapter 1 arranged in-between. The adapter 1 comprises a tubular outer conductor of the adapter 3 and a pin-shaped inner conductor of the adapter 4 both extending in a mounted position in a longitudinal direction (z-direction). The inner conductor of the adapter 4 electrically connects an inner conductor of the first connector part 18 with an inner conductor of the second connector part 20. Meanwhile, the outer conductor of the adapter 3 electrically connects an outer conductor of the first connector part 19 with an outer conductor of the second connector part 21. In the mounted position, a spacer 5, made of electrically insulating material, is arranged inside the outer conductor of the adapter 3 encompassing the inner conductor of the adapter 4 at least partly such that said inner conductor 4 is positioned with respect to the outer conductor of the adapter 3. In the shown variation, the spacer 5 comprises a first half 5*a* and a second half 5*b* which are interconnectable to each other along a separation plane extending in the longitudinal direction (z-direction). The spacer 5 with the first and/or the second half 5*a*, 5*b* further comprises at least one holding means 6 to hold the inner conductor of the adapter 4 in the mounted position. In the mounted position, the lateral extension of the inner conductor 4 is arranged perpendicular with respect to the separation plane of the spacer 5.

The inner conductor of the adapter 4 consists in the shown case of one punched sheet metal part with a defined thickness (in y-direction). At both ends in longitudinal direction (z-direction) the inner conductor of the adapter 4 comprises fork-like extensions 7. Each fork-like extension 7 is formed by two legs 26. In lateral direction, the edges of the fork-like extensions 7 press against a respective contact surfaces 30 to ensure the electrical contact to the inner conductors of the connector parts 18, 20. The contact surfaces 30 are each located at frontal ends of the respective inner conductors of the connector parts 18, 20 facing the adapter. The frontal ends of the inner conductors of the connector parts 18, 20 are shaped like a hollow cylinder section, whereby the contact surfaces 30 are located at the inner circumferential surface of the respective hollow cylinder in which the fork-like extensions 7 are inserted in the mounted position.

The outer conductor of the adapter 3 further comprises multiple spring tongues 27 at both ends in longitudinal direction to ensure the electrical path of the outer conductor. The spring tongues 27 are formed by multiple slots 28 (compare FIG. 3) in longitudinal direction and each comprise a contact bead 25 that presses outwards against respective contact surfaces 34 of the outer conductors of the connector parts 19, 21.

In the mounted position, the adapter 1 is electrically interconnected to the second connector part 17 through a fork-like extension 7 (inner conductors) and spring tongues 27 (outer conductors). The interconnection to the first connector part 16 additionally features a mechanical connection 24 between the spacer 5 and the first connector part 16. The mechanical connection 24 interconnects in the shown case the first connector part 16 and the assigned end of the adapter 1 "fixedly" to each other. In contrast thereto, the connection of the second connector part 17 to the adapter 1 can be released at a lower force level. The mechanical connection 24 can e.g. consist of multiple latches 14 formed on the spacer 5, which latch behind a circumferential holding bead 29. In the shown case, the holding bead 29 is part of an insulator 23 of the second connector part 16. For an interconnection, the latches 14 have to bend outwards to then latch behind the holding bead 29. Therefore, a clearance 31 circumvents the latches 14 at its outer side in order to enable the latches 14 to bend outwards. To provide the optimum capture range during interconnection, the second connector part 17 may further provide a capture funnel 22 to accommodate for displacements of the adapter 1 in respect to the second connector part 17 during interconnection. The capture funnel 22 can be attached to the second connector part 17 as a separate part or the capture funnel 22 can be an integral part of said connector part.

Figure 3:
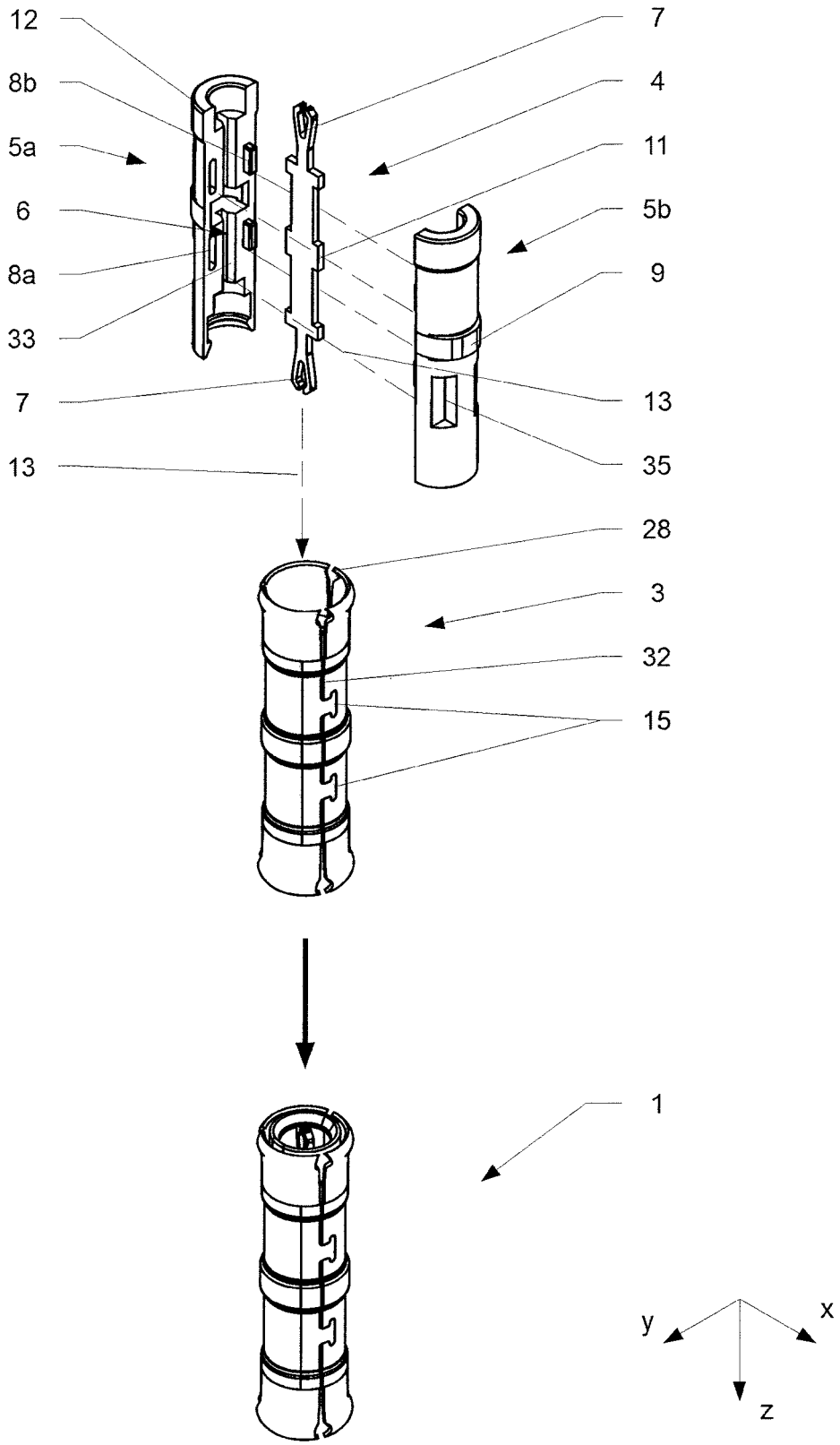
FIG. 3 shows a schematic view of the assembly of the adapter.
Figure 4:
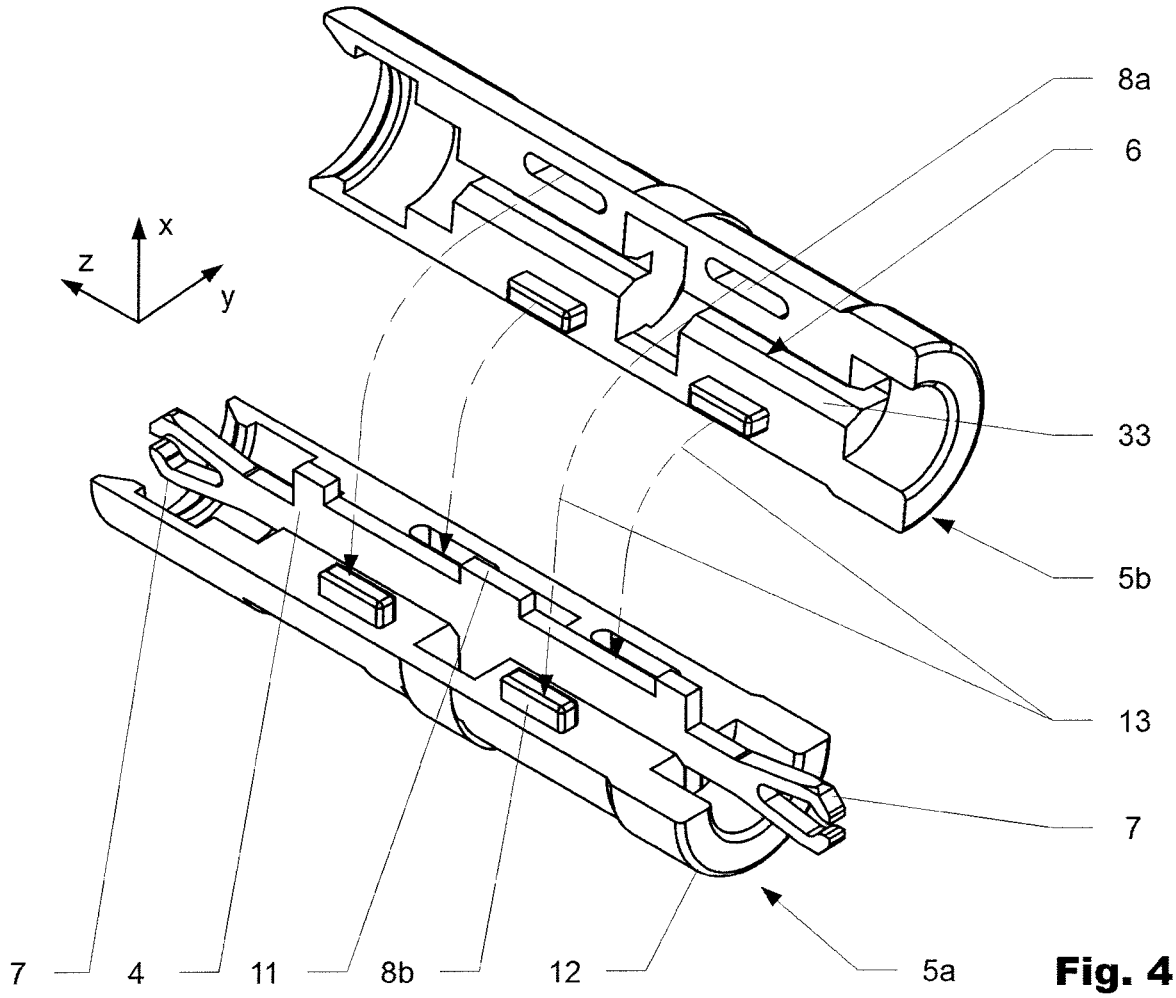
FIG. 4 shows a schematic view of the assembly of an inner conductor of the adapter into the two spacer halves.
Figure 5:
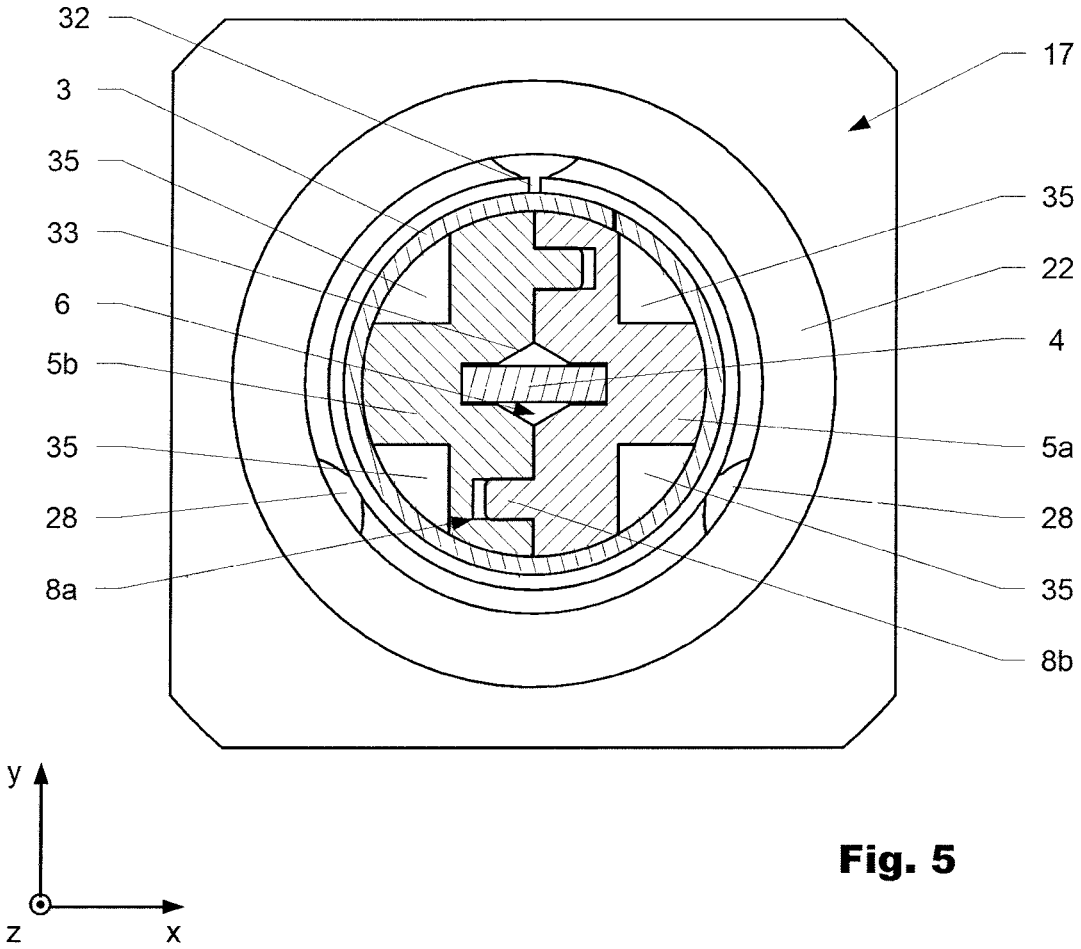
FIG. 5 shows the coaxial connector assembly according to FIG. 1 in another sectional view.

FIG. 3 and FIG. 4 illustrate the assembly of the adapter 1. For the assembly the inner conductor of the adapter 4 is placed in the holding means 6 which in this case is a recess in the first and the second part of the spacer 5*a*, 5*b*. The inner conductor of the adapter 4 is placed in the two spacer halves 5*a* 5*b* essentially perpendicular to the separation plane extending in the longitudinal direction. To plug-in the inner conductor of the adapter 4 into the respective spacer half 5*a*, 5*b* the recess 6 may comprise lead-in surfaces 33 that circumvent at least partly the recess 6 in the separation plane, in order so guide the inner conductor of the adapter 4 into the recess 6. This can also be seen in FIG. 5, which is another sectional view of the coaxial connector assembly according to FIG. 1 or FIG. 2. Furthermore, interconnection means 8 are present on the first and the second part of the spacer 5*a*, 5*b* for the interconnection of said halves 5*a*, 5*b* to each other during assembly. In the shown variation of the adapter 1, multiple interconnection means 8 are present. Each interconnection means 8 is formed by a recess 8*a* and a corresponding protrusion 8*b* on the respective spacer halves 5*a*, 5*b* which fit into each other and secure the two spacer halves (compare also FIG. 5). The assembled inner conductor of the adapter 4 encompassed by the assembled spacer 5 further fit into the outer conductor of the adapter 3. The outer shape of the assembled spacer 5 is hereby designed in such a way that the assembled spacer can be inserted from the longitudinal direction into the outer conductor of the adapter 3. In FIG. 3 can also be seen that the outer conductor of the adapter 3 may consist of at least one punched sheet metal part. This punched metal part has been reshaped to form a hollow cylinder. Therefore, two opposite edges of the punched sheet metal are interconnected through engagement means 15 at an interconnection section 32. The outer conductor of the adapter 3 further comprises at the middle (in respect to the longitudinal direction) at its inner surface a circumferential depression 10. In the shown variation, the spacer 5 comprise a respective snap-fit 9, which snaps in the circumferential depression 10 during insertion of the spacer 5 in the outer conductor of the adapter 3 and thereby secures the spacer 5 with respect to the outer conductor of the adapter 3 in the longitudinal direction (z-direction). In the shown variation the snap-fit 9 is present on both spacer halves 5*a*, 5*b*. The snap-fit is realized by a circumferential ring (one half-ring on one spacer half) that is connected through thin bridges to the rest of the respective spacer halves 5*a*, 5*b*. During insertion of the assembled spacer 5 in the outer conductor of the adapter 3 the snap-fit ring 9 can be deformed radially inwards to fit into the outer conductor of the adapter and snaps outwards in its original form when the ring 9 reaches the circumferential depression 10.

The words used in the specification are words of description rather than limitation, and it is understood that various changes may be made without departing from the spirit and scope of the invention.

The invention claimed is:

1. An adapter (1) for a coaxial connector assembly (2) comprising:

a. a tubular outer conductor (3) and a pin-shaped inner conductor (4) both extending in a mounted position in a longitudinal direction (z) and b. a spacer (5) which in the mounted position is arranged inside the outer conductor (3) encompassing the inner conductor (4) at least partially and by which the inner conductor (4) is positioned with respect to the outer conductor (3), wherein c. the spacer (5) comprises a first half (5*a*) and a second half (5*b*) which are interconnectable to each other along a separation plane extending in the longitudinal direction (z), wherein d. the first and/or the second half (5*a*, 5*b*) comprise at least one holding means (6) to hold the inner conductor (4) in the mounted position, and wherein e. the inner conductor (4) of at least one punched sheet metal part, and wherein f. the inner conductor (4) having a generally rectangular cross-section, defined by a constant thickness in a y-direction and a lateral dimension in a lateral direction (x).

2. The adapter (1) according to claim 1, wherein the lateral dimension of the inner conductor (4) varies over a length of the inner conductor (4).

3. The adapter (1) according to claim 2, wherein the inner conductor (4) comprises, with respect to the longitudinal direction (z), a widening portion in a middle portion of the inner conductor.

4. The adapter (1) according to claim 1, wherein in the mounted position the lateral dimension of the inner conductor (4) is arranged perpendicular with respect to the separation plane of the spacer (5).

5. The adapter (1) according to claim 1, wherein the inner conductor (4) comprises with respect to the longitudinal direction (z) at least at one end a fork-like extension (7).

6. The adapter (1) according to claim 1, wherein the at least one holding means (6) comprises a recess and/or a protrusion to receive the inner conductor (4).

7. The adapter (1) according to claim 1, wherein the first half and the second half of the spacer (5*a*, 5*b*) comprise interconnection means (8) to mechanically interconnect the first half and the second half of the spacer (5*a*, 5*b*) to each other during assembly.

8. The adapter (1) according to claim 1, wherein an outer shape of the spacer (5) and an inner shape of the tubular outer conductor (3) are designed such that the spacer (5) can be inserted into the outer conductor (3) in the longitudinal direction (z).

9. The adapter (1) according to claim 8, wherein the spacer (5) and the outer conductor of the adapter (3) comprise one of a snap-fit (9) or a thereto corresponding depression (10) which interact with each other in the mounted position thereby securing the spacer (5) with respect to the outer conductor (3) in the longitudinal direction (z).

10. The adapter (1) according to claim 1, wherein the outer conductor (3) comprises at least one punched sheet metal part.

11. The adapter (1) according to claim 1, wherein the spacer (5) is made from a dielectric material.

12. A coaxial connector assembly (2) comprising an adapter (1) of claim 1.

* * * * *